United States Patent [19]

Schydlo

[11] Patent Number: 4,892,464

[45] Date of Patent: Jan. 9, 1990

[54] PUMP MEANS FOR SWIMMING POOLS AND SIMILAR FACILITIES

[76] Inventor: Martin T. Schydlo, Am Obersthof 25, D-4030 Ratingen 6, Fed. Rep. of Germany

[21] Appl. No.: 190,775

[22] Filed: May 6, 1988

Related U.S. Application Data

[63] Continuation of Ser. No. 907,672, Sep. 15, 1986, abandoned.

[30] Foreign Application Priority Data

Oct. 17, 1985 [DE] Fed. Rep. of Germany ..... 3537039

[51] Int. Cl.[4] ..... F04B 23/04

[52] U.S. Cl. ..... 417/201; 417/371; 417/423.8; 417/423.14

[58] Field of Search ..... 417/201, 307, 311, 371, 417/368, 423 G, 423 H, 423 T; 4/492, 493, 542, 543

[56] References Cited

U.S. PATENT DOCUMENTS

| | | | |
|---|---|---|---|
| 1,387,296 | 8/1921 | Nelson | 417/311 |
| 1,569,845 | 1/1926 | Murphy | 417/371 |
| 1,601,531 | 9/1926 | Jeannin | 417/423 T |
| 3,521,978 | 7/1970 | Enemark | 417/371 |
| 4,052,757 | 10/1977 | Dotson | 4/172.17 |
| 4,518,325 | 5/1985 | Kingston | 417/368 |

FOREIGN PATENT DOCUMENTS

| | | |
|---|---|---|
| 1034260 | 7/1958 | Fed. Rep. of Germany . |
| 6810216 | 12/1968 | Fed. Rep. of Germany . |

*Primary Examiner*—Carlton R. Croyle
*Assistant Examiner*—Eugene L. Szczecina, Jr.
*Attorney, Agent, or Firm*—John F. A. Earley; John F. A. Earley, III; P. Michael Walker

[57] ABSTRACT

A pump apparatus for supplying water and air via suitable respective feeding apparatus to a swimming pool or similar facility, with an electric motor for driving the pump apparatus comprising channel sections surrounding, at least partially, the electric motor by forming an annular gap, the air being feedable through the channel sections to a collecting chamber which is connected to a supply member for delivering air to said water feeding apparatus and/or to said swimming pool.

18 Claims, 2 Drawing Sheets

PUMP MEANS FOR SWIMMING POOLS AND SIMILAR FACILITIES

This is a continuation of copending application Ser. No. 907,672 filed on Sept. 15, 1986, now abandoned.

The present invention relates to motor-driven means, in particular water pump means, and more particular to water pump means used for swimming pools and similar facilities. Similar facilities with respect to the present invention are, e.g., whirl-pools, bathtubs for private and medical uses, fish ponds, and water reservoirs in general.

In recent years it has become increasingly popular to provide swimming pools and similar facilities, in particular so-called whirl-pools, with devices supplying pressurized water in rather closely confined streams by means of jet devices to the pool. Furthermore, air under pressure can be supplied to the pool in a similar manner. Usually, water and air are mixed and fed into the pool via a so-called Venturi jet.

Water and air are fluids with rather different characteristics; in particular air is compressible whereas water is virtually incompressible. Therefore, two different pumps are usually employed in such cases, a water pump such as a rotary pump, and a different air pump or "blower".

Air pumps or blowers have proved to be a source of noise which is particularly troublesome for installations, e.g. in hotels, where bathtubs are provided with air pumps or blowers and where the individual blower has to be installed in close proximity to the respective bathtub.

A water pump for swimming pool applications is disclosed in Swiss patent specification 607,591. The water pump is driven by an electric motor and for safety reasons the pump section and the motor section are disposed in two sections of the unit separated by a dividing wall.

German Auslegeschrift specification 2,550,754 discloses a motor-driven water pump with three outlet pipes for pressurized water. Two of the pipes are led directly to jet devices in bottom and wall sections of a swimming pool, respectively. The third water pipe leads to another jet device and is connected, in the pipe section leading from the water pump to the jet device, to another pipe through which air is supplied to the water pipe and mixed with the water before the water enters the jet. The amount of air sucked into the water pipe cannot be controlled during the operation of the water pump. A separate stream of pure air cannot be supplied to the pool with the device described in this reference, being also a source of great noise. U.S. Pat. No. 1,866,368 discloses portable tools driven by an electric motor, for instance hair dryers with a built-in motor. The motor is cooled by channels for the air left free between the stator laminations of the motor and the inside surface of a casing. The channels can be provided by forming a ring-shaped hollow space between the motor and the casing. Such hand-held tools, however, bear no resemblance to pumps for either water or air.

It is therefore an object of the present invention to provide a pump means for supplying water and air to a swimming pool or a similar facility which emits less noise and which is less bulky than prior art devices.

It is another object of the present invention to provide a pump means for supplying water and air which needs a single drive motor only.

It is still another object of the present invention to provide a pump means for supplying water and air which needs less energy for its operation and which has lower operating costs than known devices.

It is still another object of the present invention to provide an electric motor with an auxiliary source for pressurized air.

These and further objects of the invention are achieved by providing, according to the present invention, a pump means for supplying water and air via suitable respective feeding means to a swimming pool or similar facility, with an electric motor for driving the pump means, comprising channel section means surrounding, at least partially, the electric motor by forming an annular gap, the air being feedable through the channel section means to a collecting means which is connected to supply means for delivering air to said water feeding means and/or to said swimming pool.

Thus, according to the invention, the air cooling the water pump motor is not wasted any more but used instead for another useful purpose, i. e. for generating an air stream which can be supplied to a pool.

The pump unit according to the present invention is much more compact than prior art units because a separate air pump is no longer necessary. Another advantage of the pump unit according to the present invention is its low cost in operation, because the cooling air which was formerly wasted can now be used effectively, and its low cost in manufacturing, because a separate air pump with a separate drive motor is no longer necessary.

Furthermore, the air supplied by the pump unit according to the present invention has the additional advantage that it has been heated because of the interaction with the motor which is being cooled by the air. Warm or hot air is very suitable to be employed in swimming pools.

For the compression of the air some additional energy has to be provided by the water pump motor. This is, however, only a small amount of energy as compared to the energy which would be necessary to drive a separate air pump. Discarding a separate air pump has the distinct advantage that a source of noise is eliminated. The noise-limiting effects of a pump unit according to the present invention are even enhanced by the air stream in the channel surrounding the motor because it serves as a cushion which reduces the noise formerly emitted by the motor.

In a preferred embodiment of the present invention said collecting means comprises chamber means connected to said channel section means. Thus, the chamber serves as a pressure reservoir.

In another preferred embodiment of the present invention said collecting means comprises air conveying means, in particular impeller means, and said air conveying means is coupled to said motor. In this manner, a very simple and cost-effective air supply means is provided. This desirable effect can even be increased if, according to another preferred embodiment of the present invention, said motor and said impeller means are coaxially aligned with each other and if said motor and said impeller means preferably comprise common shaft means.

According to another preferred embodiment of the present invention said chamber means is rotationally symmetric and is aligned coaxially with the longitudinal axis of said motor. Thus, the channel can be made from a piece of tubing with an inner diameter which is larger than the outer diameter of the motor, such motors usually being of cylindrical shape.

An impeller might not be sufficient if higher air pressures are desired. To achieve higher pressures it is suggested, according to another preferred embodiment of the present invention, to provide rotatable air conveying means, preferably conveyor worm means, said conveyor means being rotatable around an axis which is aligned in perpendicular relationship to a motor axis.

In the above-mentioned embodiments of the invention, the cooling air is led over the outer surface of the motor and then collected. According to another preferred embodiment of the present invention the air is led through the inside of the motor, and for that purpose said motor comprises air intake means and at least one air outlet opening, said air outlet opening being arranged in an end section of said motor in opposite relationship to said air intake means, said air outlet opening being connected to supply means for delivering air to said water feeding means and/or to said swimming pool. In this embodiment it is preferred to employ a ventilator paddle-wheel rotor means being arranged at a face of said motor. In this case it is advantageous if a chamber means is provided as a collecting means, the chamber means surrounding said end section of said motor being provided with said at least one air outlet opening.

In another preferred embodiment of the present invention said supply means is connected to a unidirectional means for conveying the medium. In this manner the compressed air can flow in the desired direction only. This ensures that, in case of a malfunction, water cannot enter the motor through the air supply means by flowing in the wrong direction. A simple means for this purpose is a unidirectional valve, e.g. a flap valve.

If, for any reason, for instance because of a blocked air jet, an air pressure builds up, adequate air flow for cooling can not be maintained and ultimately the air supply means might be damaged. In order to minimize such hazards it is suggested, according to another preferred embodiment of the present invention, that a pressure relief means is connected to said supply means, said pressure relief means initiating its pressure relief action at a predeterminable pressure.

Of course, the pump means according to the present invention can be used not only with swimming pools, but, to great advantage, with a variety of facilities, in particular with whirlpools. In these small-scale applications the noise-limiting properties of the pump unit according to the present invention are very desirable.

In these applications, the water conveyed by said pump means and the air supplied by said collecting means are supplied to the whirl-pool. For this purpose, according to another preferred embodiment of the invention, the air having been conveyed and the water having been pumped are, at least partially, mixed, either shortly before or during supply into said whirl-pool, for instance in a Venturi jet.

The invention will be described in more detail with reference to a description of preferred embodiments of the invention in connection with the drawings.

Figure 1:
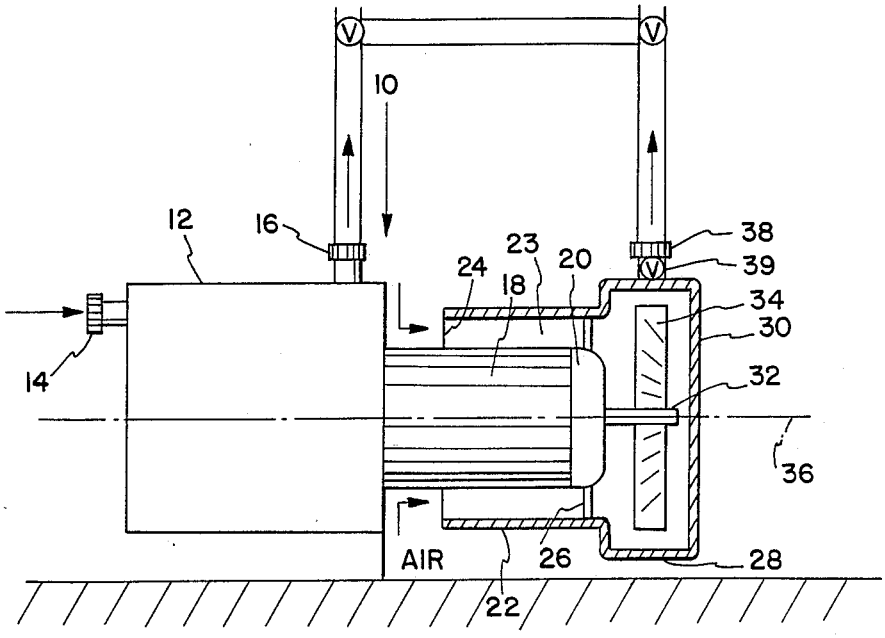
FIG. 1 shows a first embodiment of the invention, partially in a sectional view.

In FIG. 1, a water pump unit 10 has a water pump casing 12 which is provided with a water inlet connection piece 14 and an outlet 16 for pressurized water. The water pump disposed in the water pump casing 12 is not shown in detail and can, for instance, comprise a usual single- or multiple-stage rotary pump known to a person skilled in the art.

The water pump is driven by an electric motor 18, the casing of which has a cover lid 20. The electric motor 18 can be interlocked with the water pump casing 12 in such a manner that the motor axis extending along the longitudinal axis 36 extends, safely sealed, through the water pump casing 12 and is engaged with a suitably formed catch of the water pump.

The main section of the electric motor 18 is enclosed by a tube section 22 which abuts, via webs 24, 26, the electric motor 18 and its cover 20, respectively. The diameter of the section 22 is designed such that sufficient space 23 is provided between the section 22 and the motor 18 for the transport of cooling air which enters the annular gap between tube section 22 and the electric motor 18 at the locations marked by arrows.

Annexed to the tube section 22 is an enlarged chamber section 28 the face of which is closed by a cover lid 30. A motor axis 32 extends from the electric motor 18 into the chamber section 28 and is provided, at that location, with an air impeller 34.

The air impeller serves a double purpose: at the start of the electric motor 18 for operating the water pump unit 10 the impeller 34, which is rigidly coupled to the axis 32 of the electric motor 18, is put in motion and takes in air, in the direction shown by the arrows in FIG. 1, through the annular gap 23 between motor 18 and the tube section 22. The tube section extends preferably far, up to the pump casing 12, in order to have a contact area between air and motor casing as large as possible and in order to maximize the injector effect. This air passes over the main part of the electric motor 18 and cools it. The air is heated in return and is compressed in chamber 28 by means of the impeller 34 and is subsequently discharged by an air outlet connection piece 38 branching off chamber 28. Surprisingly, the air intake noise has proved to be extremely little and, in particular, much less than the noise emitted by separate air pumps. The pressurized air is subsequently led via a compressed-air pipe or hose to a swimming pool into which it is introduced in a manner mentioned above.

A flap valve can be connected to the outlet connection piece 38 for enabling compressed air to flow from chamber 28 to a swimming pool, but preventing another medium, for instance water, for entering chamber 28 and damaging the impeller and/or the electric motor 18.

Furthermore, a pressure relief means 39 can be connected to the outlet connection piece 38. The pressure relief means 39 opens at a predetermined pressure and releases the excess pressure to the outside. In this manner a pressure buildup, caused for example by a malfunction in the piping leading to the swimming pool, can be avoided which otherwise might have back effects into chamber 28 and might damage the electric motor 18 because insufficient cooling.

Figure 2:
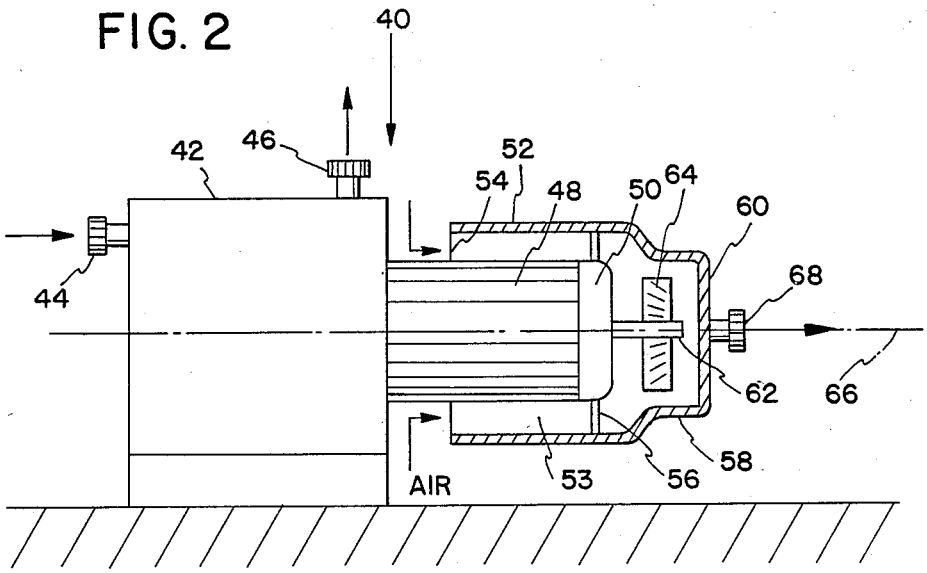
FIG. 2 shows another embodiment of the invention, partially in a section view.

FIG. 2 shows another preferred embodiment of a water pump unit 40 which resembles the embodiment of figure 1 in essential parts. The air collecting chamber, however, is different in the embodiment of FIG. 1 and figure 2, respectively.

Water pump unit 40 comprises a water pump casing 42 with a water inlet connection piece 44 and a pressurized water outlet connection piece 46. An electric motor 48 is connected and operationally engaged with the water pump casing 42 and is provided with a motor cover lid 50 at its face opposite to the casing 42. The cylindrically shaped electric motor 48 is surrounded by a cylindrically shaped channel section 52 abutting, via webs 54, 56 radially disposed at the circumferential surface of the electric motor 48, the electric motor 48, thus being held in a fixed distance to the motor.

At the side of channel section 52 opposite to an air intake slot marked by arrows the annular channel 53 tapers to a chamber section 58 the face of which is closed by a lid 60. A motor axis 62 of the electric motor 48 extends into chamber 58 and carries a ventilator paddle-wheel rotor 64. In the direction marked by the arrows air is taken in between channel section 52 and the outer surface of electric motor 48 and is led along the outer surface of electric motor 48 into the chamber surrounded by chamber section 58 and compressed. The compressed, heated air is discharged by an air outlet connection piece 68 which is coaxially disposed to a center axis 66 of the whole unit, as described before. The higly symmetric arrangement of the embodiment shown in FIG. 2 has an especially low flow resistance and especially small outer dimensions.

Figure 3:
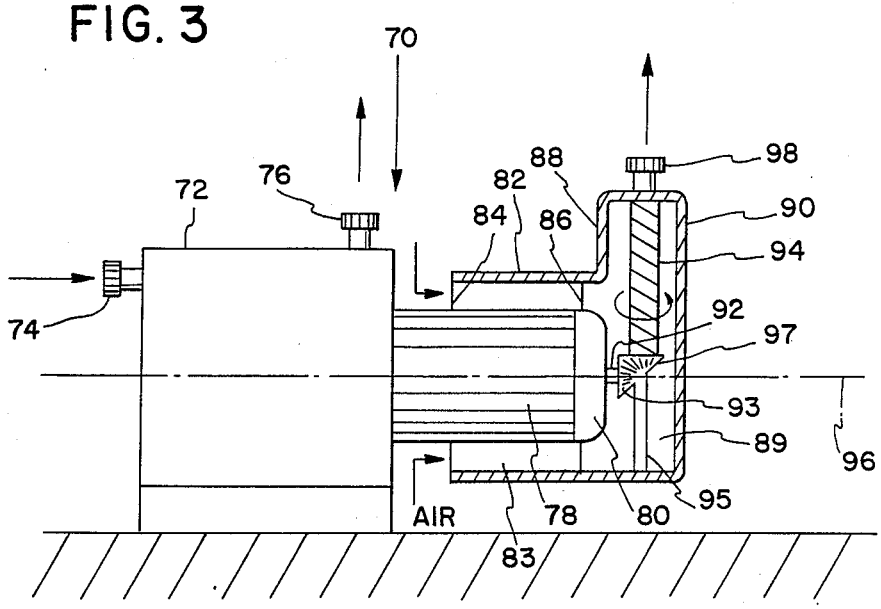
FIG. 3 shows still another embodiment of the invention, partially in a sectional view, with a shaft of an air conveyor which is not coaxially aligned with a motor axis.

FIG. 3 shows another preferred embodiment of the present invention. A water pump unit 70 comprises a water pump casing 72 with a water inlet connection piece 74 leading to a water pump which is not shown in detail. The pressurized water delivered by the water pump is directed to an outlet connection piece 76.

The water pump is drivingly connected to an electric motor 78. The main part of the length of electric motor 78 is surrounded by a tube-shaped channel section 82. Channel section abuts, via webs 84, 86, electric motor 78. Approximately near a motor cover lid 80 channel section 82 is annexed to a chamber section 88. This chamber section 88 extends substantially in a transverse direction to a longitudinal axis 96 of the water pump unit. A motor axis 92 extends from electric motor 78 through motor cover lid 80 and has a conical gear wheel 93 at its front section extending into chamber 89. This conical gear wheel engages another conical gear wheel 97 which is secured on a shaft 95. Shaft 95 is disposed in transverse relation to longitudinal axis 96 and motor axis 92, respectively. A worm-shaped ventilator means 94 is disposed on shaft 95.

When the motor axis 92 and the conical gear wheel 93 secured thereto start to turn conical gear wheel 97, which engages conical gear wheel 93, is set into motion and thus, finally, worm-shaped air conveyor 94 on shaft 95 is set in motion. Now, worm-shaped air conveyor 94 conveys air in the direction to outlet connection piece 98 and, in this manner, takes in cooling air, in the direction marked by the arrows, through annular gap chamber 83 into the section of chamber 89.

Figure 4:
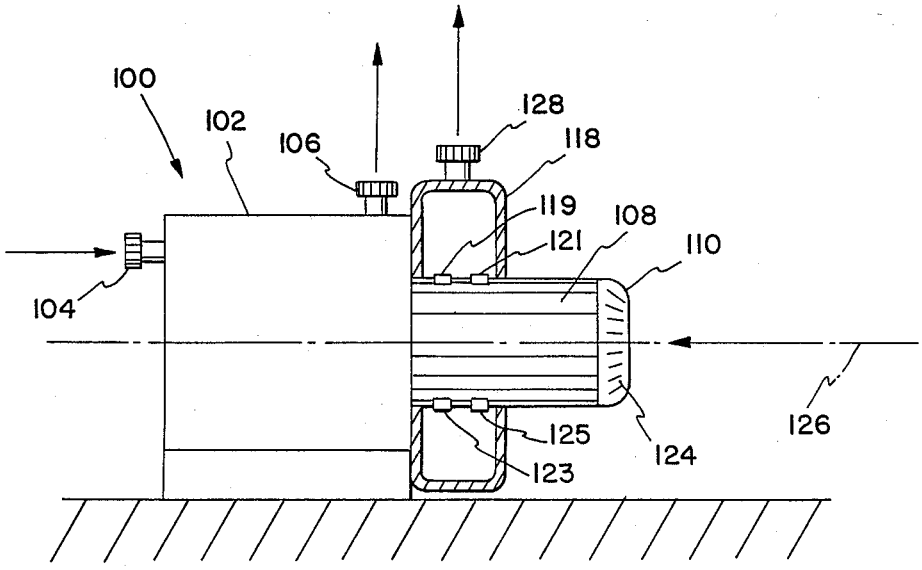
FIG. 4 shows still another embodiment of the invention, partially in a sectional view, where cooling air is conveyed through the inside of a motor.

The preferred embodiment of the invention shown in figure 4 has a water pump unit 100 which, in its water pump part, corresponds to the embodiments as described above, and also comprises a water pump casing 102 with a water pump not shown in detail, a water inlet connection piece 104, and a pressurized water outlet connection piece 106. The water pump lockingly engages an electric motor 108. A motor cover lid 110 disposed at the free end of electric motor 108 is provided with several recesses for intake of cooling air into electric motor 108. In the spaced surrounded by motor cover lid 110 a paddle-wheel rotor 124 is disposed on the central drive shaft (not shown in detail) of electric motor 108.

In the embodiment of the invention shown in FIG. 4, contrary to the embodiments described above, the air is not led over the outer surface of the electric motor, but into the electric motor 108 instead, as indicated by the arrow parallel to a center axis 126 of the water pump unit of FIG. 4.

The cooling air discharges, after heating up in the inside of electric motor 108, through recesses 119, 121, 123, and 125, which are disposed in the section adjacent to water pump casing 102 along the outer circumference of electric motor 108. In the region of the recesses 119, 121, 123, and 125 the casing of electric motor 108 is surrounded by an annular gap chamber section 118 in an air-tight manner. The heated cooling air is therefore collected in chamber section 118 and can be discharged through a compressed air outlet connection piece 128.

The embodiment of the invention shown in FIG. 4 has very small longitudinal dimensions, in the direction of longitudinal axis 126.

The safety features described above in connection with the embodiment of FIG. 1, like the unidirectional flap valve or the pressure relief means can, of course, be employed with the embodiments of FIGS. 2, 3, and 4 in a similar fashion. Furthermore, for example the position of the respective air outlet connection piece at the compressed air collecting chamber is not limited to the positions as shown in the figures, and, in general, the air outlet connection piece can be in any position downstream of the air conveying means.

It is to be noted that all features as discernible from the claims, the description, and the drawings can be essential for embodiments of the invention, as single features and in combination. All these embodiments which are within the true scope of the invention as described above are to be protected.

I claim:

1. A pump apparatus for supplying water and air via suitable respective feeding means to a swimming pool or similar facility, comprising a water pump, an electric motor having a casing for driving the water pump, and collecting means connected to the electric motor for pulling air over the casing of the electric motor for according contact of this air with the inner workings of the motor and the oil and grease associated therewith and for heating the air and for cooling the motor and for collecting the heated air in a chamber, the output of said collecting means being adapted to be connected to conduit means for delivering air to said water feeding means or said swimming pool, the collecting means including a channel section means for surrounding, at least partially, the electric motor and the electric motor casing, and for forming an annular gap therebetween through which air is pulled to heat the air and to cool the motor.

2. A pump apparatus as defined in claim 1, said collecting means including a chamber in which air is collected and compressed

3. A pump apparatus as defined in claim 1, said collecting means including an an air impeller for moving the air, said impeller being connected to said motor.

4. A pump apparatus as defined in claim 3, said motor and said impeller being coaxially aligned with each other and said motor and said impeller having a common shaft.

5. A pump apparatus as defined in claim 2, said chamber means being dynamically balanced and aligned coaxially with the longitudinal axis of said motor.

6. A pump apparatus as defined in claim 1, the collecting means including rotatable air conveying means, preferably conveyor worm means, said conveyor means being rotatable around an axis which is aligned in perpendicular relationship to a motor axis.

7. A pump apparatus as defined in claim 2, a pressure relief means for relieving pressure in the chamber being operatively connected to said chamber, said pressure relief means initiating its pressure relief action at a predetermined pressure.

8. A pump apparatus for supplying water and air via suitable respective feeding means to a swimming pool or similar facility, comprising a water pump, an electric motor having a casing for driving the water pump, and collecting means connected to the electric motor for pulling air over the casing of the electric motor for avoiding contact of this air with the inner workings of the motor and the oil and grease associated therewith and for heating the air and for cooling the motor and for collecting the heated air in a chamber, the output of said collecting means being adapted to be connected to conduit means for delivering air to said water feeding means or to said swimming pool, said collecting means including a chamber in which air is collected and compressed, said collecting means including an impeller for moving the air, said impeller being connected to said motor, said motor and said impeller being coaxially aligned with each other and having a common shaft, said chamber being aligned coaxially with the longitudinal axis of said motor and being axially symmetric with respect to the longitudinal axis of said motor, and further including a pressure relief means for relieving pressure in the chamber being operatively connected to said chamber, said pressure relief means initiating its pressure relief action at a predeterminable pressure, and the collecting means including a channel section means for surrounding, at least partially, the electric motor and the electric motor casing, and for forming an annular gap therebetween through which air is pulled to heat the air and cool the motor.

9. A pump apparatus for supplying water and air via suitable respective feeding means to a swimming pool or similar facility, comprising a water pump, an electric motor having a casing for driving the water pump, and collecting means connected to the electric motor for pulling air over the casing of the electric motor for avoiding contact of this air with the inner workings of the motor and the oil and grease associated therewith and for heating the air and for cooling the motor and for collecting the heated air in a chamber, the output of said collecting means being adapted to be connected to conduit means for delivering air to said water feeding means or to said swimming pool, the collecting means including a channel section means for surrounding, at least partially, the electric motor and the electric motor casing, and for forming an annular gap therebetween through which the air is pulled to heat the air and cool the motor, the collecting means including a chamber connected to the channel section means, said collecting means including an impeller for moving air through the annular gap and over the casing of the electric motor into the chamber, the impeller being connected to the electric motor and located within the chamber, the electric motor and the impeller being coaxially aligned with each other and having a common shaft, the chamber being aligned coaxially with the longitudinal axis of the motor and being axially symmetric with respect to the longitudinal axis of the motor,a and further including a pressure relief means for relieving pressure in the chamber being operatively connected to said chamber, said pressure relief means initiating its pressure relief action at a predeterminable pressure.

10. A pump apparatus for supplying water and air via suitable respective feeding means to a swimming pool or similar facility, comprising a water pump, an electric motor having a casing for driving the water pump, and collecting means for pulling air over the casing of the electric motor for avoiding contact of this air with the inner workings of the motor and the oil and grease associated therewith and for heating the air and for cooling the motor and for collecting the heated air in a chamber, the output of said collecting means being adapted to be connected to conduit means for delivering air to said water feeding means or to said swimming pool, the collecting means including a channel section means for surrounding, at least partially, the electric motor and the electric motor casing, and for forming an annular gap therebetween through which air is pulled to heat the air and to cool the motor.

11. A pump apparatus for supplying water and air via suitable respective feeding means to a swimming pool or similar facility, comprising a water pump, an electric motor with a casing for driving the water pump, and collecting means, connected to the motor, for pulling air through an annular channel formed by a tube section surrounding the casing of the motor at least partially and with a distance to said casing and for pulling air past the casing of the electric motor for avoiding contact of this air with the inner workings of the motor and the oil and grease associated therewith and for heating the air and for cooling the motor and for collecting the heated air in a chamber, opposite the water pump and annexed to the tube section, the output of said collecting means being adapted to be connected to conduit means for delivering air to said water feeding means or to said swimming pool.

12. A pump apparatus as defined in claim 11, wherein said collecting means includes a chamber in which air is collected and compressed.

13. A pump apparatus as defined in claim 11, wherein said collecting means includes an air conveying means, in particular an impeller, said air conveying means being adapted to said motor.

14. A pump apparatus as defined in claim 11, wherein the collecting means includes rotatable air conveying means, preferably conveyor worm means, said conveyor means being rotatable around an axis which is aligned in perpendicular relationship to a motor axis.

15. A pump apparatus as defined in claim 12, wherein a pressure relief means for relieving pressure in the chamber is operatively connected to said chamber, said pressure relief means initiating its pressure relief action at a predeterminable pressure.

16. A pump apparatus as defined in claim 11, wherein said motor and said collecting means are coaxially aligned with each other and wherein said motor and said collecting means have a common shaft.

17. A pump apparatus for supplying water and air via suitable respective feeding means to a swimming pool or similar facility, comprising a water pump, an electric motor with a casing, for driving the water pump, and collecting means, connected to the motor, for pulling air through an annular channel formed by a tube section surrounding the casing of the motor at least partially and with a distance to said casing and for pulling air past the casing of the electric motor for avoiding contact of this air with the inner workings of the motor and the oil and grease associated therewith and for heating the air and for cooling the motor and for collecting the heated air in a chamber, opposite the water pump and annexed to the tube section, the output of said collecting means being adapted to be connected to conduit means for delivering air to said water feeding means or to said swimming pool.

18. A pump apparatus for supplying water and air via suitable respective feeding means to a swimming pool or similar facility, comprising a water pump, an electric motor with a casing, for driving the water pump, and collecting means, connected to the motor, for pulling air through an annular channel formed by a tube section surrounding the casing of the motor at least partially and with a distance to said casing and for pulling air past the casing of the electric motor for avoiding contact of this air with the inner workings of the motor and the oil and grease associated therewith and for heating the air and for cooling the motor and for collecting the heated air in a chamber, opposite the water pump and annexed to the tube section, the output of said collecting means being adapted to be connected to conduit means for delivering air to said water feeding means or to said swimming pool, wherein said collecting means includes a chamber in which air is collected and compressed and wherein said collecting means includes an air conveying means, in particular an impeller, said air conveying means being adapted to said motor, wherein said motor and said collecting means are coaxially aligned with each other and wherein said motor and said collecting means have a common shaft.

* * * * *